US006099113A

United States Patent [19]

Blouin et al.

[11] Patent Number: 6,099,113

[45] Date of Patent: Aug. 8, 2000

[54] CONTINUOUS JET PRINTER MIXING SYSTEM

[75] Inventors: Matthew R. Blouin, Townsend, Mass.; Scott T. Burnett, Derry, N.H.; Terry A. McArthur, Acton, Mass.

[73] Assignee: Iris Graphics, Bedford, Mass.

[21] Appl. No.: 09/042,034

[22] Filed: Mar. 13, 1998

[51] Int. Cl.[7] ..... B41J 2/175

[52] U.S. Cl. ..... 347/85

[58] Field of Search ..... 347/85, 86, 87, 347/54, 73

[56] References Cited

U.S. PATENT DOCUMENTS

| | | |
|---|---|---|
| 1,157,092 | 10/1915 | Du Reil . |
| 1,924,038 | 8/1933 | Herbsman et al. . |
| 3,261,593 | 7/1966 | Sharples . |
| 3,291,456 | 12/1966 | Deane . |
| 3,620,507 | 11/1971 | Kruka . |
| 3,798,656 | 3/1974 | Lowy et al. . |
| 4,123,800 | 10/1978 | Mazzei . |
| 4,196,437 | 4/1980 | Hertz . |
| 4,199,769 | 4/1980 | Fischbeck . |
| 4,270,576 | 6/1981 | Takeda et al. . |
| 4,285,367 | 8/1981 | Nommensen . |
| 4,337,032 | 6/1982 | Duplouy et al. . |
| 4,345,841 | 8/1982 | Day . |
| 4,415,275 | 11/1983 | Dietrich . |
| 4,486,102 | 12/1984 | Thiele et al. . |
| 4,519,423 | 5/1985 | Ho et al. . |
| 4,591,875 | 5/1986 | McCann . |
| 4,607,261 | 8/1986 | McCann et al. . |
| 4,614,953 | 9/1986 | Lapeyre . |
| 4,633,909 | 1/1987 | Louboutin et al. . |
| 4,662,759 | 5/1987 | Leibee et al. . |
| 4,734,711 | 3/1988 | Platt et al. . |
| 4,771,297 | 9/1988 | Lecheheb et al. . |
| 4,809,015 | 2/1989 | Bowling et al. . |
| 4,811,035 | 3/1989 | Huliba et al. . |
| 4,814,788 | 3/1989 | Davies . |
| 4,853,708 | 8/1989 | Walters . |
| 4,860,787 | 8/1989 | Grosselin . |
| 4,875,055 | 10/1989 | McCann et al. . |
| 4,879,565 | 11/1989 | Fujii . |
| 5,126,752 | 6/1992 | Weinberg . |
| 5,380,164 | 1/1995 | Fry et al. . |
| 5,394,177 | 2/1995 | McCann et al. . |
| 5,424,766 | 6/1995 | Anderson . |
| 5,450,111 | 9/1995 | Mutoh . |
| 5,455,614 | 10/1995 | Rhodes . |
| 5,459,497 | 10/1995 | Manning et al. . |
| 5,526,026 | 6/1996 | Bowers . |
| 5,682,191 | 10/1997 | Barrett et al. . |
| 5,685,639 | 11/1997 | Green . |
| 5,688,046 | 11/1997 | Triassi et al. . |
| 5,705,060 | 1/1998 | Robberts . |

*Primary Examiner*—N. Le
*Assistant Examiner*—Michael Nghiem
*Attorney, Agent, or Firm*—Fish & Richardson P.C.

[57] ABSTRACT

A continuous jet printer includes a mixer defining a first fluid inlet for receiving a first fluid, a second fluid inlet for receiving a second fluid, and a fluid outlet. The mixer mixes the first and second fluids to produce a printing fluid. A fluid source is in fluid communication with the inlets for delivering the fluids. A jet nozzle in fluid communication with the mixer delivers drops of the printing fluid to a substrate. The fluid source delivers the fluids to the inlets at an operating pressure of the jet nozzle. A method of printing includes mixing the fluids at an operating pressure of the jet nozzle to produce a printing fluid. The printing fluid is delivered to an inlet of the jet nozzle at the operating pressure of the jet nozzle, and a substrate is printed with drops of the printing fluid exiting the jet nozzle.

18 Claims, 3 Drawing Sheets

CONTINUOUS JET PRINTER MIXING SYSTEM

BACKGROUND OF THE INVENTION

This invention relates to a continuous jet printer mixing system.

As described in Jochimsen, U.S. Pat. No. 4,639,736, titled INK JET RECORDER, incorporated by reference herein, continuous ink jet printers produce a continuous stream of ink drops directed at a substrate. As described in Kellett, U.S. Ser. No. 08/645,747, titled MATERIALS USEFUL IN LITHOGRAPHIC PRINTING PLATES, filed May 14, 1996, now U.S. Pat. No. 5,738,013 incorporated by reference herein, a continuous ink jet printer can be used to deliver two mixed fluids to a substrate to produce a lithographic printing plate.

SUMMARY OF THE INVENTION

In one aspect, the invention features a continuous jet printer including a mixer defining a first fluid inlet for receiving a first fluid, a second fluid inlet for receiving a second fluid, and a fluid outlet. The mixer is configured to mix the first and second fluids to produce a printing fluid. The continuous jet printer also includes a fluid source in fluid communication with the first and second inlets for delivering the first fluid to the first fluid inlet and the second fluid to the second fluid inlet. A jet nozzle of the printer defines a nozzle inlet in fluid communication with the mixer outlet and a nozzle outlet for delivering drops of the printing fluid to a substrate. The fluid source is configured to deliver the first fluid to the first inlet and the second fluid to the second inlet at an operating pressure of the jet nozzle.

Embodiments of this aspect of the invention may include one or more of the following features.

The operating pressure of the jet nozzle is between about 200–600 psi. The fluid source includes a first pump having an outlet in fluid communication with the first fluid inlet, and a second pump having an outlet in fluid communication with the second fluid inlet. A capillary tube having an inner diameter of about 100 microns defines the mixer outlet. A mixer housing defines a central channel connecting the first fluid inlet and the second fluid inlet, and a side channel which intersects with the central channel and is in fluid communication with the outlet. Check valves are located in the first and second fluid inlets. A third inlet of the mixer receives a third fluid from a fluid source.

According to another aspect of the invention, a capillary assembly including a capillary tube located in the mixer outlet is configured to mix the first and second fluids at an operating pressure of the jet nozzle to produce the printing fluid.

In another aspect, the invention features a method of printing including delivering a first fluid to a first inlet of a mixer at an operating pressure of a jet nozzle, and delivering a second fluid to a second inlet of the mixer at the operating pressure of the jet nozzle such that the first and second fluids are mixed to produce a printing fluid. The printing fluid is delivered to an inlet of the jet nozzle at the operating pressure of the jet nozzle, and a substrate is printed with drops of the printing fluid exiting the jet nozzle.

Embodiments of this aspect of the invention may include pressurizing the first and second fluids to the operating pressure of the jet nozzle with a fluid source located upstream of the mixer such that the fluid source is substantially free from residual printing fluid.

Among other advantages, the mixing of the printing fluid takes place downstream of the fluid source which pressurizes the fluids to the operating pressure of the nozzle. Thus, any residual printing fluid left in the printer which degrades and must be cleaned out will not be located in the pumps of the fluid source which can be difficult to clean. The residual printing fluid in the printer is easily removed because the printing fluid only contacts a limited number of components of the printer.

DESCRIPTION OF THE PREFERRED EMBODIMENTS

Figure 1:
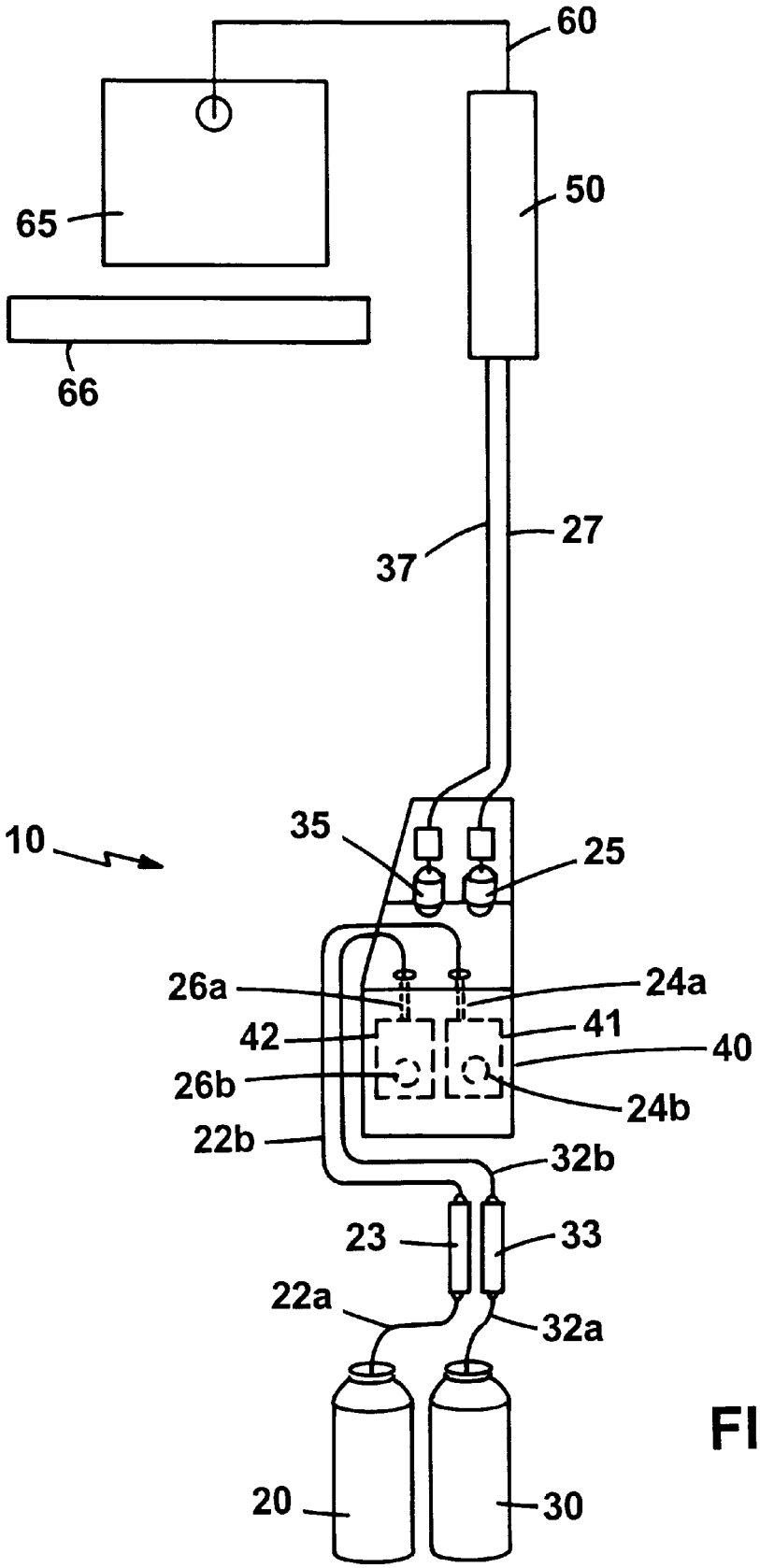
FIG. 1 is a schematic of a mixing system for a continuous jet printer.

Referring to FIG. 1, a mixing system 10 of a continuous jet printer includes a pump assembly 40 for delivering two fluids to a mixer 50. Mixer 50 mixes the fluids to produce a printing fluid and delivers the printing fluid to a printhead 65. Printhead 65 is, e.g., a continuous ink jet printer printhead, such as described in Barrett et al., U.S. Pat. No. 5,682,191, titled INK SET PRINTING APPARATUS HAVING MODULAR COMPONENTS, incorporated by reference herein, and Barrett et al., INK JET ASSEMBLY, filed Mar. 13, 1998, incorporated by reference herein. Drops of printing fluid exit the printhead and contact a substrate 66.

A continuous jet printer with mixing system 10 can be used to produce a lithographic printing plate. A properly selected diluent and concentrate delivered to mixer 50 at the operating pressure of the printhead are mixed to form printing fluid used to produce a lithographic printing plate. Drops of the printing fluid are delivered to the printing plate substrate by printhead 65 prior to degradation of the printing fluid. Suitable diluents and concentrates are described in Kellett, supra.

Jet printing assembly 10 mixes the diluent and concentrate directly upstream of the printhead at the operating pressure of the printhead. Any residual printing fluid left in the jet printer which degrades and must be cleaned out will not be located in pump assembly 40 which can be difficult to clean. The degraded printing fluid is easily removed because the printing fluid only contacts a limited number of components of the printer.

The diluent and concentrate are stored in containers 20, 30, respectively, of printing assembly 10. Diluent exiting container 20 travels to pump assembly 40 via tubes 22*a*, 22*b* and low pressure filter 23. Concentrate exiting container 30 travels to pump assembly 40 via tubes 32*a* and 32*b* and low pressure filter 33. Pump assembly 40 houses two pumps 41, 42. Pumps 41, 42 each include an inlet 24*a*, 26*a*, respectively, and an outlet 24*b*, 26*b*, respectively. Diluent enters pump 41 through inlet 24*a* and exits pump 41 as a pressurized fluid through outlet 24*b*. Similarly, concentrate enters pump 42 through inlet 26*a* and exits pump 42 as a pressurized fluid through outlet 26*b*. Pumps 42, 41 are, e.g., syringe pumps of the type commonly used in high pressure liquid chromatography applications.

Diluent flowing from outlet 24*b* is delivered to mixer 50 via high pressure filter 25 and tube 27. Concentrate flowing from outlet 26*b* is delivered to mixer 50 via high pressure filter 35 and tube 37. After mixing of the concentrate and diluent, the printing fluid flows from mixer 50 to printhead 65 via a tube 60.

Figure 2:
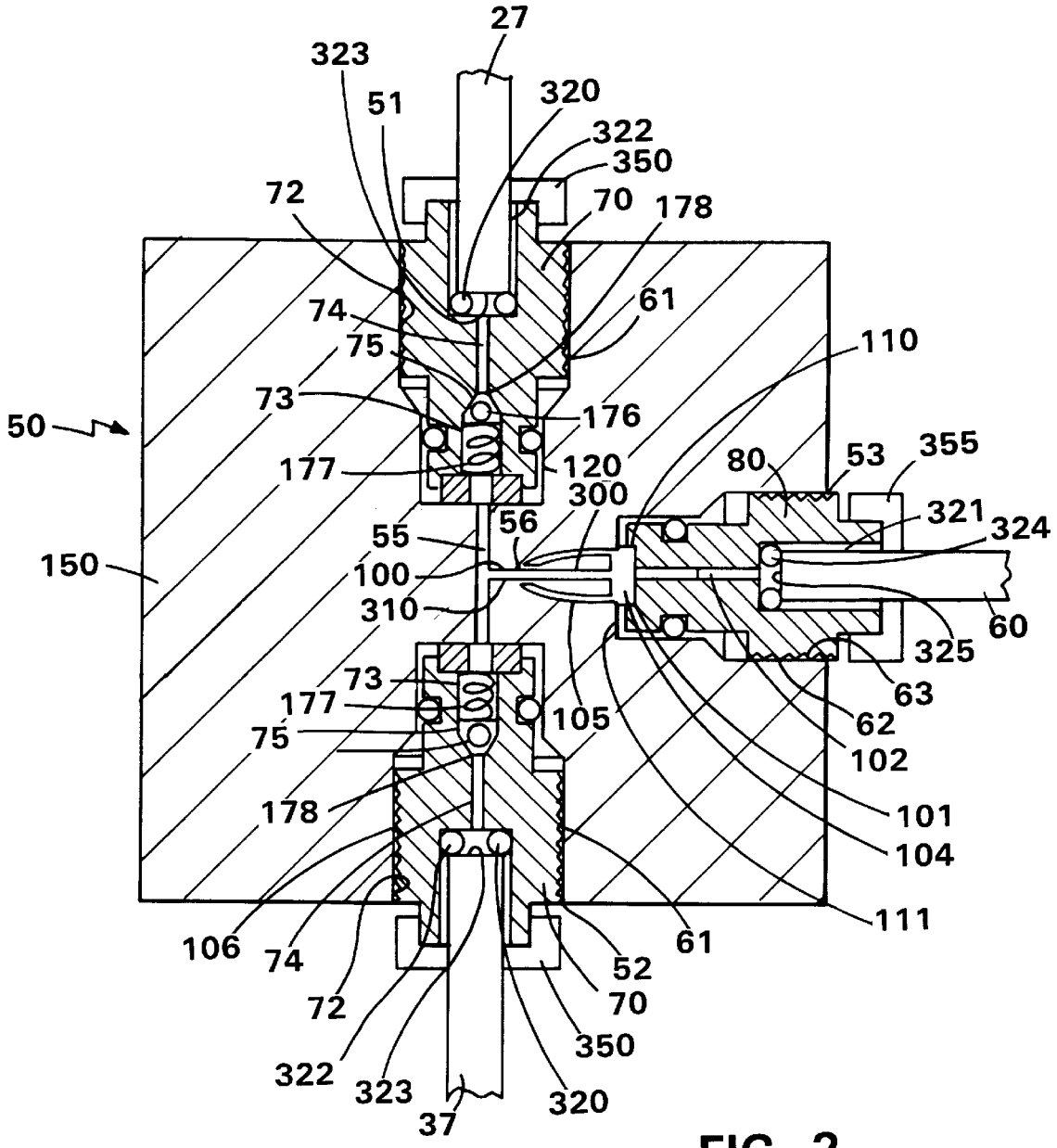
FIG. 2 is a cross-section of a mixer of the mixing system of FIG. 1.

Referring to FIG. 2, mixer 50 receives the pressurized diluent and concentrate from pump assembly 40 through inlet ports 51, 52, respectively. The printing fluid exits mixer 50 at an outlet port 53. A housing 150 of mixer 50 defines inlet ports 51, 52, outlet port 53, as well as a central bore 55 connecting the inlet ports, and a side bore 56 connecting the outlet port to the central bore. Side bore 56 intersects central bore 55 at, e.g., about 90°.

A valve assembly 70 is received in each of inlet ports 51, 52. The inlet ports are threaded at 61 and the valve assemblies have corresponding threads at 72 to threadably engage the threaded inlet ports. Each valve assembly 70 defines a central bore 74 and a valve chamber 73. A check valve 75 is received in valve chamber 73. Each check valve 75 includes a ball valve 176 and a biasing spring 177. Spring 177 forces ball valve 176 to abut a wall 178 of each valve assembly 70 to block flow through the valve assembly's central bore 74. Tubes 37, 27 are connected to valve assemblies 70 by fittings 320. Fittings 320 each include an o-ring 322 and a compressing nut 350 for compressing an end 323 of tubes 37, 27 against o-ring 322 to form a face seal.

An outlet assembly 80 is received in outlet port 53. The outlet port is threaded at 62 and the outlet assembly has corresponding threads at 63 to threadably engage the threaded outlet port. Outlet assembly 80 defines a central bore 102. A capillary assembly 101 is located at an end 111 of mixing assembly 80. Capillary assembly 101 includes a ferrule 104 having a central bore 300 capillary tube 100. Capillary tube 100 extends from within central bore 102 through ferrule 104 such that an end 120 extends beyond an end 310 of the ferrule. Ferrule 104 forms an air tight seal with capillary 100, and a wall 105 of housing 150. Ferrule 104 is a compression fitting, e.g., typical of those used to make connections within chromatography equipment. Tube 60 is connected to outlet assembly 80 by a fitting 321. Fitting 321 includes an o-ring 324 and a compressing nut 355 for compressing an end 325 of tube 60 against o-ring 324 to form a face seal.

Typically, housing 150 is a block of any machinable material, e.g., aluminum, steel, plastic, or ceramic, having dimensions of, e.g., about 1"×2"×2". Central bore 55 and side bore 56 have a diameter of, e.g., about 0.03 inch. Inlets 51, 52 and outlet 53 have a distal portion 110 having a diameter of, e.g., about 0.360 inch and proximal portion 106 having a diameter of, e.g., about 0.5 inch. Central bores 74 of valve assemblies 70 have a diameter of, e.g., about 0.03 inch. Central bore 102 of mixing assembly 80 has a diameter of, e.g., about 0.03 inch. Capillary 100 is, e.g., a glass capillary tube with an outer diameter of about 250 micron and an inner diameter selected to cause mixing of the diluent and concentrate, e.g., about 100 micron.

Mixing system 10 can be incorporated into a commercially available continuous ink jet printer, such as RealistFX 5015 & 5030 ink jet printers available from IRIS Graphics, Inc., Bedford, Mass.

In operation, pumps 41, 42 of pump assembly 40 are used to draw the diluent and concentrate from containers 20, 30, respectively, and deliver the drawn fluids under high pressure, e.g., 200–600 psi, to mixer 50. The diluent and concentrate enter mixer 50 through tubes 27, 37 and flow into the respective central bores 74 of valve assemblies 70. The force of the each fluid causes check valves 75 to open, i.e., ball valves 176 compress biasing springs 177, allowing the diluent and concentrate to enter central bore 55. Once in central bore 55 the diluent and concentrate are forced into capillary tube 100 and with mixing of the fluids to produce the printing fluid. The printing fluid continues to flow out of mixer 50 through central bore 102 and into tube 60 leading to printhead 65. While flowing through mixer 50, the diluent and concentrate are at the operating pressure of the printhead.

The operating pressure of each pump is determined by the pressure required by printhead 65 for continuous jet printing. The flow of diluent through mixer 50 is at about 0.10–0.30 cc/min, and the flow of concentrate through mixer 50 is at about 0.05–0.001 cc/min. Preferably, the diluent flow rate is about 0.18–0.22 cc/min, and the concentrate flow rate is about 0.03–0.01 cc/min. The flow rates, pressures, and components used in mixing can be changed accordingly to yield a wide range of printable fluids.

Other embodiments are within the following claims.

Figure 3:
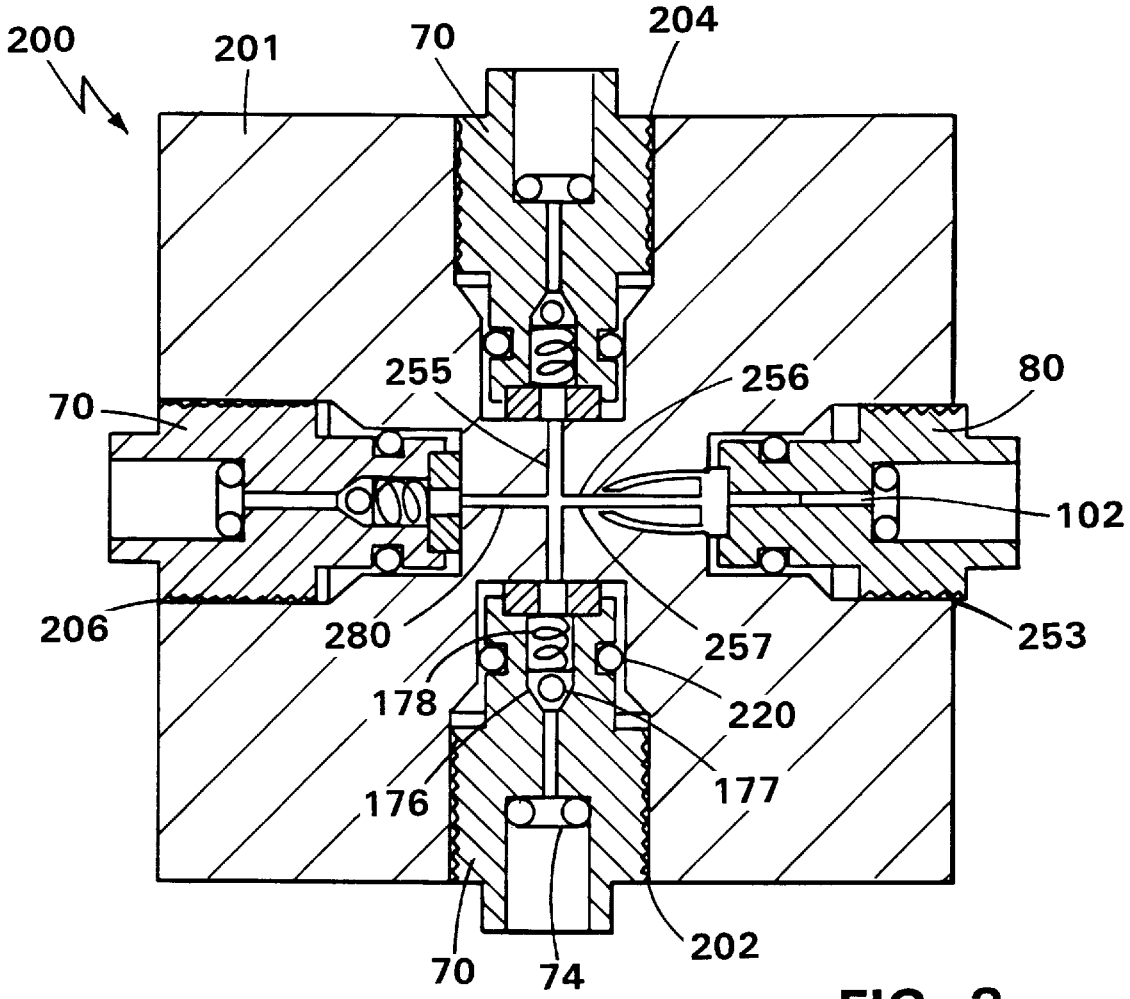
FIG. 3 is a cross-section of another embodiment of a mixer.

For example, referring to FIG. 3, a mixer 200 receives the diluent and concentrate from pump assembly 40 through inlet ports 202, 204, respectively and the printing fluid exits mixer 200 at an outlet port 253, as described above. Mixer 200 also defines a third inlet port 206 for receiving a flushing fluid. After the diluent and concentrate have been mixed to produce a printing fluid, as described above, the flushing fluid can be passed through third inlet port 206 to remove residual diluent and concentrate from mixer 200.

A housing 201 of mixer 200 defines inlet ports 202, 204, 206, outlet port 253, as well as a central bore 255 connecting the inlet ports 202, 204, and a side bores 256, 280 connecting the outlet port 253 and inlet port 206, respectively, to central bore 255. Side bores 256, 280 intersect central bore 55 at, e.g., about 90°. As described above, a valve assembly 70 is received by the inlets 202, 204, or 206 and an outlet assembly 80 is received in outlet 253.

In addition, mixing system 10 can be used to deliver a printing fluid that does not require mixing, e.g., a single fluid. For example, a single fluid from a fluid container is passed through pump assembly 40 and mixer 50 to printhead 65.

What is claimed is:

1. A continuous jet printer, comprising:

a mixer defining a first fluid inlet for receiving a first fluid, a second fluid inlet for receiving a second fluid, and a fluid outlet, the mixer being configured to mix the first and second fluids to produce a printing fluid, a first fluid source in fluid communication with the first fluid inlet and a second fluid source in fluid communication with the second fluid inlet, and a jet nozzle defining a nozzle inlet in fluid communication with the mixer outlet and a nozzle outlet for delivering drops of the printing fluid to a substrate, the first and second fluid sources being configured to deliver the first fluid to the first fluid inlet and the second fluid to the second fluid inlet at an operating pressure of the jet nozzle ranging between about 200 and 600 psi.

2. The continuous jet printer of claim 1, wherein the first fluid source comprises a first pump having a first outlet in fluid communication with the first fluid inlet and the second fluid source comprises a second pump having a second outlet in fluid communication with the second fluid inlet.

3. The continuous jet printer of claim 1, further comprising a capillary tube defining the mixer outlet.

4. The continuous jet printer of claim 3, wherein the capillary tube has an inner diameter of about 100 microns.

5. The continuous jet printer of claim 1, further comprising a housing, wherein the housing defines a central channel connecting the first fluid inlet and the second fluid inlet.

6. The continuous jet printer of claim 5, wherein the housing defines a side channel intersecting with the central channel and in fluid communication with the fluid outlet.

7. The continuous jet printer of claim 6, further comprising a first check valve located in the first fluid inlet and a second check valve located in the second fluid inlet.

8. The continuous jet printer of claim 1 further including a third fluid source, the mixer further defining a third inlet for receiving a third fluid from the third fluid source.

9. The continuous jet printer of claim 1 wherein the first fluid comprises concentrated printing fluid and the first fluid source delivers the printing fluid to the first fluid inlet at a flow rate between about 0.001 and 0.05 cubic centimeters per minute.

10. The continuous jet printer of claim 9, wherein the flow rate of the first fluid is between about 0.01 and 0.03 cubic centimeters per minute.

11. The continuous jet printer of claim 1 wherein the second fluid comprises diluent and the second fluid source delivers the diluent to the second fluid inlet at a flow rate between about 0.1 and 0.3 cubic centimeters per minute.

12. The continuous jet printer of claim 11, wherein the flow rate of the second fluid is between about 0.18 and 0.22 cubic centimeters per minute.

13. A mixer for an ink jet printer, comprising:

a housing including a central bore defining a first fluid inlet for receiving a first fluid, a second fluid inlet for receiving a second fluid, and a side channel defining a mixer outlet, the side channel intersecting the central bore between the first inlet and the second fluid inlet;

a first check valve located in the first fluid inlet, a second check valve located in the second fluid inlet; and a capillary tube located in the mixer outlet and configured to mix the first and second fluids at an operating pressure of a jet nozzle to produce a printing fluid.

14. The mixer of claim 13, wherein the capillary tube has a diameter of about 100 microns.

15. A method of printing, comprising the steps of:

delivering a first fluid to a first inlet of a mixer at an operating pressure of a jet nozzle ranging between about 200 and 600 psi, delivering a second fluid to a second inlet of the mixer at the operating pressure of the jet nozzle, mixing the first and second fluids to produce a printing fluid, delivering the printing fluid to an inlet of the jet nozzle at the operating pressure of the jet nozzle, and printing on a substrate with drops of the printing fluid exiting the jet nozzle.

16. The method of claim 15 further comprising pressurizing the first and second fluids to the operating pressure of the jet nozzle with a fluid source located upstream of the mixer.

17. A continuous jet printer, comprising:

a mixer defining a first fluid inlet for receiving a first fluid, a second fluid inlet for receiving a second fluid, and a fluid outlet, a capillary tube located in the fluid outlet, the capillary tube being configured to mix the first and second fluids to produce a printing fluid, a first fluid source in fluid communication with the first fluid inlet for delivering the first fluid to the first fluid inlet, and a second fluid source in fluid communication with the second fluid inlet for delivering the second fluid to the second fluid inlet, and a jet nozzle defining a nozzle inlet in fluid communication with the mixer outlet and a nozzle outlet for delivering drops of the printing fluid to a substrate.

18. The continuous jet printer of claim 17, wherein the capillary tube has a diameter of about 100 microns.

* * * * *

UNITED STATES PATENT AND TRADEMARK OFFICE

CERTIFICATE OF CORRECTION

PATENT NO. : 6,099,113
DATED : August 8, 2000
INVENTOR(S) : Matthew R. Blouin, Scott T. Burnett, and Terry A. McArthur It is certified that error appears in the above-identified patent and that said Letters Patent is hereby corrected as shown below:

Title page, [56] References cited, U.S. PATENT DOCUMENTS, please correct the following documents:

"Du Reil" should be --Du Rell--
"Platt et al." should be --Piatt et al.--

Title page, [56] References Cited, U.S. PATENT DOCUMENTS, insert the following documents:

| | | | |
|---|---|---|---|
| --4,862,192 | 8/1989 | Slomianny..... | 346/75 |
| 4,929,963 | 5/1990 | Balazar..... | 347/89 |
| 5,444,472 | 8/1995 | Due et al..... | 347/85 |
| 5,646,656 | 7/1997 | Leonhardt et al..... | 347/43 |

| | | |
|---|---|---|
| 0 642 924 | 3/1995 | European Pat. Off..... |
| WO 96/26000 | 8/1996 | WIPO..... |
| WO 97/43122 | 11/1997 | WIPO..... |

Signed and Sealed this

Seventh Day of August, 2001

*Attest:*

Nicholas P. Godici

*Attesting Officer*

NICHOLAS P. GODICI
*Acting Director of the United States Patent and Trademark Office*